United States Patent [19]

Robillard et al.

[11] 4,263,105

[45] Apr. 21, 1981

[54] ELECTROSENSITIVE RECORDING MATERIAL AND PROCESS

[75] Inventors: Jean J. Robillard, Ferney Voltaire; Claude R. Riou; Christian Nodin, both of Gex, all of France

[73] Assignee: ISSEC SA, Ferney Voltaire, France

[21] Appl. No.: 68,447

[22] Filed: Aug. 21, 1979

[51] Int. Cl.[3] ..... B41M 5/20

[52] U.S. Cl. ..... 204/2

[58] Field of Search ..... 204/2, 18.1; 427/145, 427/150, 151

[56] References Cited

U.S. PATENT DOCUMENTS

| | | | |
|---|---|---|---|
| 3,138,547 | 6/1964 | Clark | 204/2 |
| 3,355,290 | 11/1967 | Robillard | 204/18.1 |
| 3,871,972 | 3/1975 | Sekine | 204/2 |
| 3,875,023 | 4/1975 | Sekine | 204/2 |

*Primary Examiner*—T. M. Tufariello

*Attorney, Agent, or Firm*—Sherman & Shalloway

[57] ABSTRACT

An electrosensitive recording material has in a single electrosensitive layer a semiconductor oxide which may be doped or otherwise treated to have crystal surface defects, an antimony or bismuth salt and a complexing agent for modifying the electronic configuration of the salt, all components being uniformally dispersed in a binder. The sensitive layer is carried on an electrically conductive backing which is capable of generating positive charges. Permanent recordings of electrically relayed information signals are formed on the electrosensitive coating by injecting electrons from a writing electrode or stylus into the electrosensitive layer. The electrons create color centers at electron trapping centers formed when the bismuth and antimony salt complex combines with the surface defects of the semiconductor oxide.

Electrosensitive coating compositions, recording materials, recording method and apparatus are described.

19 Claims, 1 Drawing Figure

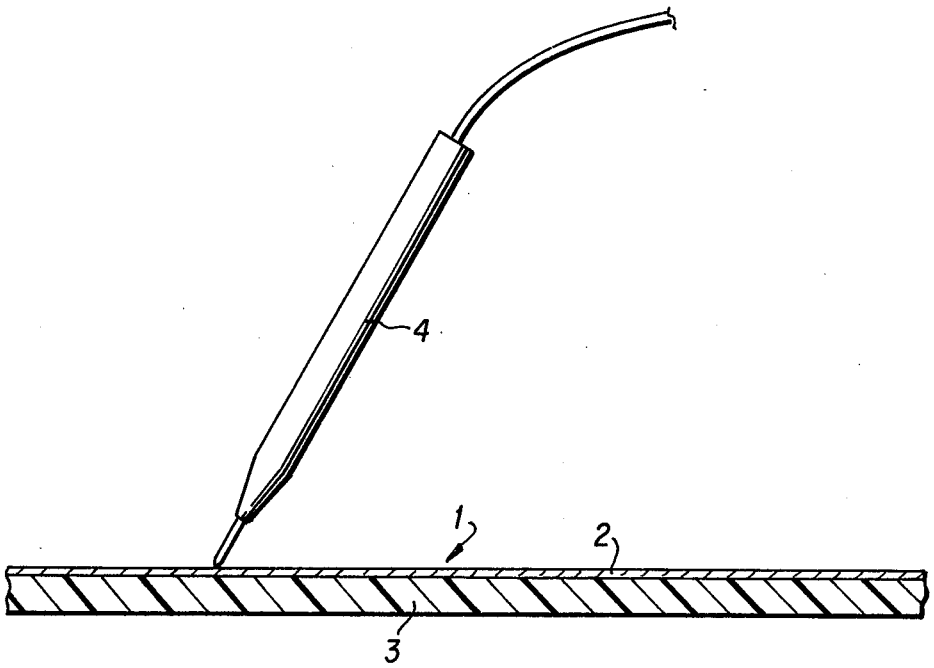
4
1
2
3

ELECTROSENSITIVE RECORDING MATERIAL AND PROCESS

BACKGROUND OF THE INVENTION

1. Field of the Invention

This invention relates to electrosensitive compositions and recording materials and process and apparatus for using same. More particularly, the present invention relates to an electrosensitive recording sheet which is highly stable, requires only low recording voltages for recording information, and is not dependent on the ambient humidity for its operation. The present invention further relates to such electrosensitive recording materials which record information through formation of color centers by injection into the electrosensitive coating of electrons.

2. Discussion of the Prior Art

Previously-known electrosensitive papers generally fall into one of four major categories. These include the following:

(1) Electrosensitive paper based on the selective removal of a white coating on a black background through the action of an electrical spark produced by a stylus moving on the surface of the recording sheet. TELEDELTOS paper (a trademark of Western Union) is representative of this type of paper. The major inconveniences of such a recording system are the high voltage required to produce the spark (several hundred volts), the low resolution due to the uncertainty of positioning the local spark; the generation of radio frequency disturbances by the spark; and the creation of odors, fumes and powdered residues due to the burning of the white coating. Other disadvantages include the limitation of the response time to the time required to recharge the capacitor to produce the spark. The recording papers in this category are relatively insensitive to variations of humidity in the ambient atmosphere.

(2) Electrochemical paper based on electroreduction or oxidation of an organic compound, such as catechol, resulting in a change in color. The problems with such recording systems are its dependence on humidity for its operation and the necessity for keeping the recording paper in sealed drums or otherwise in a humid atmosphere prior to use. Because of the humidity dependence, if the paper stays on the recorder for extended times, its usefulness will be substantially, if not completely, impaired. Other drawbacks with this category of electrosensitive recording papers are the high consumption of the electrodes and the relatively high recording power needed (20 mA and 20 volts). Papers sold by ALDEN and/or HOGAN are representative of the class of electro-chemical papers.

(3) Electrosensitive papers which are a modification of the type (1) in which reducible pigments are dispersed in a white layer. The pigments turn dark (black) due to the combination of current and heat generated by a stylus. While such recording papers, such as sold by MOTOROLA and/or 3M eliminate some of the problems associated with the Teledeltos paper, such problems are not completely eliminated. While the size of the spark can be diminished and can be more readily localized, and thus the resolution improved, the said electrosensitive papers become more sensitive to the ambient humidity, although still generally less than with the electro-chemical papers described above. These papers also exhibit a superior response time to the conventional Teledeltos paper and produce less odor, fumes and powder residues.

(4) Electrothermosensitive papers in which a thermosensitive dye is contained in a resistive layer. In this category of paper the temperature generated by the passage of current through the resistive layer causes the thermosensitive dye to turn black to produce the trace. The major drawbacks of this paper are its slow response time and limited storage time under high temperature conditions. Representative of the electrothermosensitive papers are those types of papers produced by the JUJO COMPANY.

In addition to these four major categories there have been a number of patents which have recently issued on modifications of the electrochemical type of papers discussed above. Representative of these are U.S. Pat. Nos. 3,974,041 and 4,012,292. In these electrochemical papers the necessary humidity is released by the stylus current from zeolithic water associated in pigments present in the electrosensitive layer. As far as the present inventors are aware there have been no commerical or industrial applications of these papers.

U.S. Pat. No. 3,355,290 to Jean J. Robillard, one of the present inventors, discloses a photosensitive recording paper for electro-catalytic photography. According to this patent a dry photographic process and apparatus utilizes a sensitized medium to make a permanent visible indication of received radiation such as visible light or other radiation wherein the recording medium comprises a semiconductive oxide in which a change in state of oxidation is obtained by the selective introduction of minute amounts of a catalyst in the semiconductor oxide lattice. The introduction of the catalyst ions into the semiconductor provides a stable, high contrast, recording trace. The source of the catalytic ions is provided in a separate layer from the semiconductor layer. A photoconductor is used to modulate the flow of the catalytic ions to the semiconductor layer. As disclosed in this patent the mechanism of the image forming reaction was thought to be due to the catalytic reduction of the semiconductor oxide into the colored species. It has since been recognized by the present inventors that while this explanation still holds on a macroscopic level, the exact nature of the color forming entities was color centers formed by trapping of electrons by surface defects on the semiconductor oxide lattice produced by the combination of defects in the semiconductor oxide and absorbed catalyst ion in the vicinity of the defect. Since one catalyst ion acts on a large number of defects in the oxide, a large number of color centers can be generated by the introduction of a single catalyst ion, trapped electrons injected by the electrode used in the process and apparatus of the patent, together with the catalyst ions, form the color centers. The semiconductive oxides suggested for use in this patent include, among others, $TiO_2$, $SnO_2$, $Sb_2O_3$, $Bi_2O_3$, etc.

U.S. Pat. No. 3,490,941, also issued to Jean J. Robillard, discloses an electrosensitive paper which does not require a separate electroconductive backing layer. The mechanism of the color forming reaction is substantially the same as for the previous patent but is limited to those semiconductor oxides which can be precipitated in the paper base, such as $Sb_2O_3$ and $Bi_2O_3$.

U.S. Pat. No. 4,091,375 of Mr. Robillard describes a solid state flat screen passive display and memory device which has some similarities to the recording systems described in the above mentioned U.S. Pat. Nos. 3,355,290 and 3,490,941, except that the color formed can be erased and that the structure of the surface defects in the semiconductor used is such that no introduction of catalyst is needed to form the trapping centers and the injection of electrons alone is sufficient to produce the color centers. The flat screen solid state display device of this patent includes a transparent support on which are placed, in succession, a tunnel junction electron injector (including metallic layer, insulating barrier layer and thin metallic layer composite), an image screen (layer of chromophoric material which can generate color centers) and a system or array of metallic electrodes spread over the surface of the image screen.

The recording papers of U.S. Pat. Nos. 3,355,290 and 3,490,941 are designed to provide permanent records whereas the flat screen display and memory device of U.S. Pat. No. 4,091,375 is designed to provide erasable images.

SUMMARY OF THE INVENTION

It is therefore an object of the present invention to provide an electrosensitive recording material capable of recording highly stable traces with good resolution and contrast.

It is a further object of the present invention to provide an electrosensitive recording material whose recording function is independent of the ambient humidity.

A further object of the present invention is to provide an electrosensitive recording paper with improved sensitivity.

A still further object of the present invention is to provide a process for producing a visible record from an electrical signal using such electrosensitive recording material.

Still yet a further object of the present invention is to provide suitable apparatus for carrying out the above noted method for producing permanent visible records characteristic of an electrical information signal.

Broadly, the present invention provides for the recording of information generated by electrical signals by the formation of color centers in a novel electrosensitive coating composition. The electrosensitive coating composition is deposited as a layer on a suitable conductive carrier which is capable of generating charges of opposite polarity to the charges injected into the electrosensitive coating layer to form the color centers. For a general description of the nature of color centers one can be referred, for example, to the above mentioned U.S. Pat. No. 4,091,375 and to the reference materials cited therein. Briefly, a color center is a lattice defect in a crystal structure which absorbs visible light to produce a local coloration from an otherwise colorless or a light or a clear colored background. Color centers exist in the form of trapped-electron centers (F) or trapped-hole centers ($V_k$ center).

The electrosensitive coating compositions of the present invention are capable of permanently recording information by injecting into the coating electrons according to an electric signal pattern corresponding to the information to be recorded. The electrosensitive coating compositions of the present invention include a semiconductor oxide capable of forming color centers, a bismuth or antimony salt and a complexing agent for the salt, all ingredients being uniformly dispersed in a binder. The complexing agent and antimony or bismuth salt form a weak complex or temporary bond providing the necessary intermediate electronic structure of the outer valence electrons of the salt such that the salt is capable of combining with the surface defects of the semi-conductor oxide to form electron trapping centers. Upon injection into the coating of electrons from a writing electrode or stylus, for example, activated by the electronic signal, color centers are formed in the coating.

Accordingly, the present invention provides a method of producing a visible record according to an electrical signal input by injecting electrons from a marking electrode or stylus which has been activated with the signal into the electrosensitive layer of the electrosensitive recording material of the present invention. Concurrently with the injection of electrons into the electrosensitive layer positive charges in a corresponding number will be transported from the electrically conductive backing into the photosensitive layer to maintain the electrically neutrality of the paper.

The present invention also provides a system for carrying out the method described above, such system capable of producing a visible record corresponding to an electrical information signal on the electrosensitive recording material of the invention. The system includes the electrosensitive recording material according to the invention, an electrode placed in movable contact with the electrosensitive coating layer of the recording paper, and means for selectively impressing an electric field from the electrode through selected portions of the electrosensitive coating to inject electrons into the coating according to the pattern of electrical information to be recorded to thereby produce color centers in response to the information signal while simultaneously causing positive charges to be injected from the conductive backing into the electrosensitive layer.

The present invention and additional objects and advantages thereof will become readily apparent from the following detailed description and accompanying drawing in which the single FIGURE illustrates an electrosensitive recording sheet according to the present invention.

DETAILED DESCRIPTION OF THE INVENTION AND PREFERRED EMBODIMENTS

Referring to the FIGURE the electrosensitive recording sheet 1 includes the electrosensitive layer 2 deposited on a suitable conductive carrier 3. The conductive carrier may be aluminum foil or similar material laminated on a paper substrate. Other metal foils or conductive materials may also be used. Metal conductors such as aluminum, nickel, copper, etc., may also be vacuum deposited on a non-conductive plastic, paper or similar substrate to form the conductive carrier. Other conductive carriers which can be used according to the present invention include, for example, coatings of a dispersion of carbon particles mixed with a positive donor material such as $Cr_2O_3$ in a suitable binder deposited on a paper base or plastic film. The purpose of the conductive backing is to facilitate exposure of the electrosensitive recording sheet 1 to the electric signal to be recorded and to generate positive charges to compensate for the electrons injected into the electrosensitive layer 2 by the electrode 4 during the recording process.

The electrosensitive layer 2 is formed of a semiconductor oxide pigment, a reactive salt of bismuth or antimony capable of reacting with the semiconductor oxide pigment to form electron trapping centers and a resinous binder throughout which the semiconductor oxide pigments and reactive salt are uniformly dispersed. The binder also serves to hold the semiconductor oxide pigments and reactive salts to the conductive backing. The electrosensitive layer can further include various additives such as complexing agents capable of forming weak temporary bonds or complexes with the reactive salts to promote the reaction between the reactive salt and the surface defects to the semiconductor oxide pigment; cross-linking agents for the binder; and surface active agents for improving the dispersion of the other ingredients and to also improve adhesion of the electrosensitive layer to the conductive backing.

Examples of suitable semiconductor oxide pigments which can be used in the present invention include $TiO_2$, ZnO, $SnO_2$, $Al_2O_3$ etc., and preferably doped with suitable doping agent to form the necessary structural defects in the crystal structure.

The reactive salts which combine with the semiconductor oxide pigments to form the electron trapping centers include inorganic and organic salts of bismuth and antimony. Suitable examples of the inorganic salts include the halides such as chlorides and bromides, and nitrates. Suitable organic salts are bismuth or antimony salts of organic acids such as salicylic acid, lactic acid and oxalic acid.

Any of the conventional resin film forming binders can be used for holding the pigment and reactive salt to the conductive carrier backing. Suitable binders include, for example, acrylic polymers, vinyl polymers, halogenated polymers and the like.

In addition to the semiconductor oxide pigment and reactive trapping center forming antimony or bismuth salt the electrosensitive layer can also include a complexing agent to form a weak temporary bond with the reactive salt. The function of the complexing agent is to assure that the electronic structure of the bismuth or antimony salt is in the proper form for reacting with the surface defects of the semiconductor oxide pigment. Suitable examples of complexing agents include, for example, halides of divalent metals such as magnesium, calcium, stronthium, barium, manganese, cobalt, iron and nickel; organic compounds such as diphenols, amides, and thioamides; and heterocyclic organic compounds such as sulfur or nitrogen containing heterocyclic compounds.

In addition to their function as complexing agents or as a separate ingredient the electrosensitive layer can also include a pH adjusting agent to facilitate the electro bonding between the bismuth or antimony salt and the surface defects of the semiconductor oxide pigment. The actual preferred pH will vary with the type of semiconductor oxide pigment selected. For a p-type conductor a slightly alkaline pH will promote the necessary ionic structure to allow the reaction to proceed. In contrast, for an n-type conductor a slightly acidic pH is preferred.

Another useful and preferred additive for the electrosensitive layer is a cross-linking agent for the resin binder. The presence of the cross-linking agent provides for a more stable recorded image. As is well known the bonds formed at the electron trapping centers are relatively weak and are subject to migration. While the ability to migrate is taken advantage of at the recording step it is undesirable to allow the color centers to migrate after they are formed. Therefore, by providing a cross-linking agent in the electrosensitive layer the binder will become cross-linked at the recording step to provide a more dense structure which effectively prevents further migration. Accordingly a cross-linking agent capable of causing cross-linking of the resinous binder upon application of local heating which will naturally result from the electric current flowing through the recording medium during the recording step should be selected. The precise cross-linking agent will be selected in accordance with the binder material. However, mention can be made of such cross-linking agents as, for example, peroxides, peresters, peracids, benzoin derivatives, azides and diazo compounds.

Adhesion of the electrosensitive layer to the conductive carrier backing is promoted by incorporating a surface active agent which can be non-ionic, anionic or cationic into the electrosensitive layer. Examples of suitable surface active agents include, for example, LISSAPOL N (a class of surfactants sold by ICI Industries Ltd.), TERGITOL (a class of trademark surfactants sold by Union Carbide), GALORYL MT41 (a trademark product of C.F.P.I.-Compagnie Francaise des Produits Industriels), etc.

Still another conventional additives such as whitening agents, for example titanium dioxide, silicon dioxide and the like can be included in the electrosensitive layer, so long as the additional additives do not interfere with the recording mechanism.

The electrosensitive layer may be prepared by grinding in a ball mill a mixture of the various ingredients together with a solvent. Any conventional solvent as aromatic and aliphatic ketones and alcohols and hydrocarbon solvents such as toluene, methylethyl ketone and ethanol can be used. The mixture is ground until a smooth dispersion is obtained. The dispersion is applied to the conductive carrier backing such as aluminum foil in a uniform layer. The solvent can be removed by evaporation at elevated temperatures and the coating is allowed to dry. Any suitable coating process may be used, for example knife coating, Meyer Rod, etc. The thickness of the coating will generally be selected to be within the range of from about 10 to about 50 microns.

Specific illustrative but non-limiting examples of the electrosensitive compositions and recording materials according to the present invention will now be given.

EXAMPLE 1

The following composition:

| | |
|---|---|
| $TiO_2$ (anatase) | 20g |
| Vilit MC34 | 20g |
| (Vinyl maleochloride, a product of Huls) | |
| Methylethylketone | 40g |
| Ethylacetate | 40g |
| Vestinol N | 9.6g |
| (Diisononylphthalate, a product of Huls) | |
| $BiCl_3$ | 4.5g |
| $CaCl_2$ | 3.7g |
| Hydroquinone | 3.5g |
| Benzoyl peroxide | 0.8g |

is ball-milled for 12 hours. The resulting smooth dispersion is spread over an aluminum foil conductive carrier having a thickness of 0.010 mm laminated on a 50 $g/m_2$ sheet of paper. By subjecting the electrosensitive layer to 20 microsecond electrical pulses with a 15 volt, 6 microampere signal a black recording is obtained.

EXAMPLE 2

The following composition:

| | |
|---|---|
| ZnO | 35g |
| VAGH (a vinylchloride/vinyl acetate copolymer product of Union Carbide) | 20g |
| Ethyl acetate | 40g |
| Acetone | 40g |
| Vestinol N (Diisonoylphthalate made by Huls) | 8g |
| $SbCl_3$ | 3.8g |
| $MgCl_2$ | 2.5g |
| Pyrocatechol | 1.5g |
| Benzoin methyl ether | 0.2g |

is ball milled for 12 hours to obtain a smooth dispersion. The dispersion is spread over the same conductive carrier as used in Example 1. To obtain a dark brown recording the electrosensitive layer of the resulting paper is subjected to a 20 microsecond electrical pulse with a 6 volt, 5 microampere signal.

EXAMPLE 3

The following composition:

| | |
|---|---|
| $SnO_2$ | 22g |
| RP 1022 (a vinyl acrylic copolymer manufactured by Monsanto) | 20g |
| Methylethylketone | 40g |
| Ethyl alcohol | 40g |
| Diethylphthalate | 6g |
| $BiCl_3$ | 4.5g |
| $BaCl_2$ | 4g |
| Benzoin methyl ether | 0.2g |

is ball milled for 12 hours to obtain a smooth dispersion which is spread over a conductive carrier made as follows:

| A composite made of: | |
|---|---|
| Acetylene black | 6.5g |
| VYNN (a resin binder of Union Carbide) | 6.4g |
| Methylethylketone | 72.3g |
| Methylisobutyl ketone | 12.2g |
| Diethylphthalate | 1.9g |
| Chromium oxide | 3.1g |
| Paraflex G25 | 0.6g |
| Stabilizer V1089 | 0.1g |

is ball milled for 23 hours. The resulting smooth dispersion is spread over a 30 g per inch square sheet of paper. The coating is dried to obtain a conductive backing with a resistivity of 85Ω square.

The electrosensitive sheet produces a black recording when subjected to a 20 microsecond electrical pulse from a 25 volt 10 microampere signal.

EXAMPLE 4

The following composition:

| | |
|---|---|
| $Al_2O_3$ | 25g |
| Vilit MC34 | 20g |
| Vinylmaleochloride (made by Huls) | 20g |
| Methyethylketone | 40g |
| Ethyl acetate | 40g |
| Vestinol N (Diisononylphthalate made by Huls) | 9.6g |
| $SbCl_3$ | 4g |
| $CaCl_2$ | 3g |
| Pyrocatechol | 2g |

-continued

| | |
|---|---|
| Benzoyl peroxide | 0.4g |

is ball milled for 12 hours to obtain a smooth dispersion which is spread over a conductive carrier prepared as in example 3. By subjecting the electrosensitive layer to 20 microsecond electrical pulses obtained from a 10 volt, 5 microampere signal black recordings can be produced.

In the above examples the recordings were made on a telecopying machine with a tungsten stylus.

Accordingly, it is seen that the present invention provides an electrosensitive coating and electrosensitive recording material which can produce permanent colored recordings which are not dependent on the ambient humidity, which have high contrast and great stability and which do not require any elaborate recording apparatus. Because the semiconductor oxide pigment is randomly oriented throughout the electrosensitive layer the recorded image will not be erased even upon application of a reverse electrical field.

What is claimed is:

1. An electrosensitive coating upon which information can be permanently recorded by injection into the coating of electrons according to an electric information signal, said coating comprising uniformly dispersed in a binder, a semiconductor oxide with surface defects capable of forming color centers, a salt selected from the group consisting of bismuth salt and antimony salts, and an agent capable of forming a weak complex with said salt, said salt capable of combining with the surface defects of said semiconductor oxide in the presence of the complexing agent to form electron trapping centers which will produce color centers upon injection into such coating of electrons from a writing electrode or stylus.

2. The electrosensitive coating of claim 1 which further comprises a cross-linking agent for said binder, said cross-linking agent being capable of cross-linking said binder upon application of heat.

3. The electrosensitive coating of claim 1 which further comprises a surface active agent.

4. An electrosensitive recording material comprising a layer of the electrosensitive coating of claim 1 carried on in electrical contact with an electrically conductive backing sheet said sheet including a material capable of generating positive charges for each electron injected in the electrosensitive layer.

5. The electrosensitive recording sheet according to claim 1 wherein said semiconductor oxide is titanium dioxide.

6. The electrosensitive recording sheet according to claim 1 wherein said semiconductor oxide is stannic oxide.

7. The electrosensitive recording sheet according to claim 1 wherein said semiconductor oxide is zinc oxide.

8. The electrosensitive recording sheet according to claim 1 wherein said semiconductor oxide is aluminum oxide.

9. The electrosensitive recording sheet according to claim 1 wherein said complexing agent is calcium chloride.

10. The electrosensitive recording sheet according to claim 1 wherein said complexing agent is barium chloride.

11. The electrosensitive recording sheet according to claim 1 wherein said complexing agent is an amide.

12. The electrosensitive recording sheet according to claim 1 wherein said complexing agent is a thioamide.

13. The electrosensitive recording sheet according to claim 4 wherein said material capable of generating positive charge is aluminum.

14. An electrosensitive recording sheet according to claim 4 wherein said compound of generating positive charge is chromium oxide.

15. Method of producing a visible record corresponding to an electrical information signal comprising the steps of injecting electrons from a marking electrode activated with said information signal into the electrosensitive layer of the electrosensitive recording material of claim 4 under conditions which will simultaneously generate a like number of positive charges which are transported into said electrosensitive layer.

16. Apparatus for producing visible records corresponding to an electrical information signal comprising the electric recording medium of claim 4, an electrode adapted to be placed in movable contact with the electrosensitive coating on said material, and means for selectively impressing an electric field through portions of the electrosensitive coating from the electrode to inject electrons into said electrosensitive coating while positive charges are injected from the conductive backing into said layer to thereby cause said coating to produce color centers in response to the information signal to be recorded.

17. The electrosensitive coating of claim 1 wherein the semiconductor oxide is selected from the group consisting of $TiO_2$, ZnO, $SnO_2$ and $Al_2O_3$.

18. The electrosensitive coating of claim 1 wherein said complexing agent is selected from the group consisting of halides of divalent metals, diphenols, amides, thioamides, heterocyclic organic sulfur compounds and heterocyclic organic nitrogen compounds.

19. The electrosensitive recording sheet according to claim 4 wherein said semiconductor oxide is selected from the group consisting of titanium dioxide, stannic oxide, zinc oxide and aluminum oxide and said complexing agent is a halide of a divalent metal.

* * * * *